US006397606B1

(12) United States Patent
Roh et al.

(10) Patent No.: US 6,397,606 B1
(45) Date of Patent: Jun. 4, 2002

(54) REFRIGERATOR SETUP SYSTEM AND METHOD

(75) Inventors: Young Hoon Roh, Seoul; Kwang Choon Kim; Jin Chul Cho, both of Kyungki-do; Jung Ho Kim, Koyang-si, all of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/991,938

(22) Filed: Nov. 26, 2001

(30) Foreign Application Priority Data

Dec. 13, 2000 (KR) ..... 2000-76109

(51) Int. Cl.[7] ..... F25B 49/00; G05D 23/00

(52) U.S. Cl. ..... 62/126; 236/51

(58) Field of Search ..... 62/126, 125; 236/51, 236/1 B; 165/11.1, 11.2; 700/17, 83; 340/870.16, 870.17

(56) References Cited

U.S. PATENT DOCUMENTS 5,398,599 A * 3/1995 Woo ..... 99/468
5,477,915 A * 12/1995 Park ..... 165/30
5,572,873 A * 11/1996 Lavigne et al. ..... 62/3.62
2001/0039805 A1 * 11/2001 Tavolazzi ..... 62/125

* cited by examiner

*Primary Examiner*—Denise L. Esquivel
*Assistant Examiner*—Marc Norman
(74) *Attorney, Agent, or Firm*—Birch, Stewart, Kolasch & Birch, LLP

(57) ABSTRACT

A setup system and method for a refrigerator having a plurality of compartments respectively adapted to perform independent refrigerating and freezing functions. The setup system and method provides an application program adapted to control refrigerating and freezing environments for the refrigerator and initialized during the manufacturing process of the refrigerator by the manufacturer. In accordance with the refrigerator setup system and method, the user is allowed to install, directly or via program providing means connected to a network, the application program to establish respective refrigerating or freezing environments desired for the compartments. Thus, it is possible to provide effects of establishing refrigerating and freezing environments for respective compartments meeting the local characteristics of the area where the refrigerator is used.

11 Claims, 5 Drawing Sheets

FIG. 3c

<< Select Enviroment >>

- Storage of Fruit/Vegetables
- Storage of Meat
- Storage of Fish
- Storage of Kimchi
- Seasoning of Kimchi
- Fermentation of Kimchi
- Production of Ice

REFRIGERATOR SETUP SYSTEM AND METHOD

FIELD OF THE INVENTION

The present invention relates to a refrigerator setup system and method, and more particularly to a setup system and method for a refrigerator including drawers respectively defined with compartments having different refrigerating and freezing environments, which system and method are adapted to set up the refrigerator using an application program selected depending on the local characteristics of the area where the refrigerator is used, thereby being capable of allowing the refrigerator to have optimum refrigerating and freezing environments for respective compartments thereof meeting the local characteristics of the area.

DESCRIPTION OF THE RELATED ART

As well known, a refrigerator is a food storing appliance provided with compartments for storing food therein. In such a refrigerator, its compartments are maintained at a desired low temperature using electricity, gas, or ice while being thermally insulated from the outside thereof using an insulator, so as to store food at a low temperature while preventing the food from being spoiled.

In homes, such a refrigerator is typically placed in a kitchen or at an area nearest to the kitchen so that it can be conveniently used by the user upon taking food materials, to be cooked, out of the refrigerator or storing cooked food in the refrigerator.

Recently, in Korea, use of kimchi refrigerators has been increased. Kimchi refrigerators are adapted to appropriately season kimchi to suit the taste of Korean people, and to store the seasoned kimchi in a fresh state. Such kimchi refrigerators are configured to provide various refrigerating and freezing environments depending on the taste of the user so that they can store kimchi under refrigerating or freezing conditions meeting the conditions given by the user.

Referring to FIG. 1, an example of a kimchi refrigerator is illustrated which has a drawer type structure including drawers each defined with a compartment. Typically, such a drawer type kimchi refrigerator is configured to provide different refrigerating or freezing environments for respective compartments thereof (for example, upper, intermediate, and lower compartments), thereby allowing food to be stored under a refrigerating or freezing condition desired by the user.

However, such a drawer type kimchi refrigerator has a fixed application program installed during the manufacturing process of the refrigerator by the manufacturer prior to the selling of the refrigerator, so that the refrigerating and freezing environments of the refrigerator are fixed irrespective of the local characteristics of the area where the refrigerator is used. As a result, there is a problem in that the refrigerator may have refrigerating and freezing environments not meeting the local characteristics of the area where the refrigerator is used.

SUMMARY OF THE INVENTION

Therefore, the present invention has been made in view of the above mentioned problems, and an object of the invention is to provide a setup system and method for a drawer type refrigerator which can provide an application program meeting the local characteristics of the area where the refrigerator is used, thereby being capable of allowing the user to set up the refrigerator to have optimum refrigerating and freezing environments meeting the local characteristics of the area.

In accordance with one aspect, the present invention provides a refrigerator setup system comprising: program providing means for providing an application program for setting up refrigerating and freezing environments for a refrigerator meeting local characteristics of an area where the refrigerator is used; communication connecting means provided at the refrigerator and adapted to allow the refrigerator to download the application program from the program providing means; communication control means for controlling the communication connecting means to connect the refrigerator and the program providing means to each other; and a refrigerator microcomputer for performing a control for refrigerating and freezing functions of the refrigerator in accordance with the downloaded application program.

In accordance with another aspect, the present invention provides a refrigerator setup method comprising the steps of: (a) constructing program providing means adapted to provide an application program meeting local characteristics of an area where a refrigerator is used; and (b) connecting the program providing means to communication connecting means provided at the refrigerator, downloading the application program from the program providing means to the refrigerator, and installing the application program in the refrigerator.

BRIEF DESCRIPTION OF THE DRAWINGS

The above and other objects, features and other advantages of the present invention will be more clearly understood from the following detailed description taken in conjunction with the drawings, in which:

FIGS. 3*a* to 3*c* are schematic views illustrating windows displayed on a display unit for downloading of an application program to the refrigerator in accordance with the present invention, respectively.

DESCRIPTION OF THE PREFERRED EMBODIMENTS

Now, preferred embodiments of the present invention will be described in conjunction with the annexed drawings.

Figure 1:
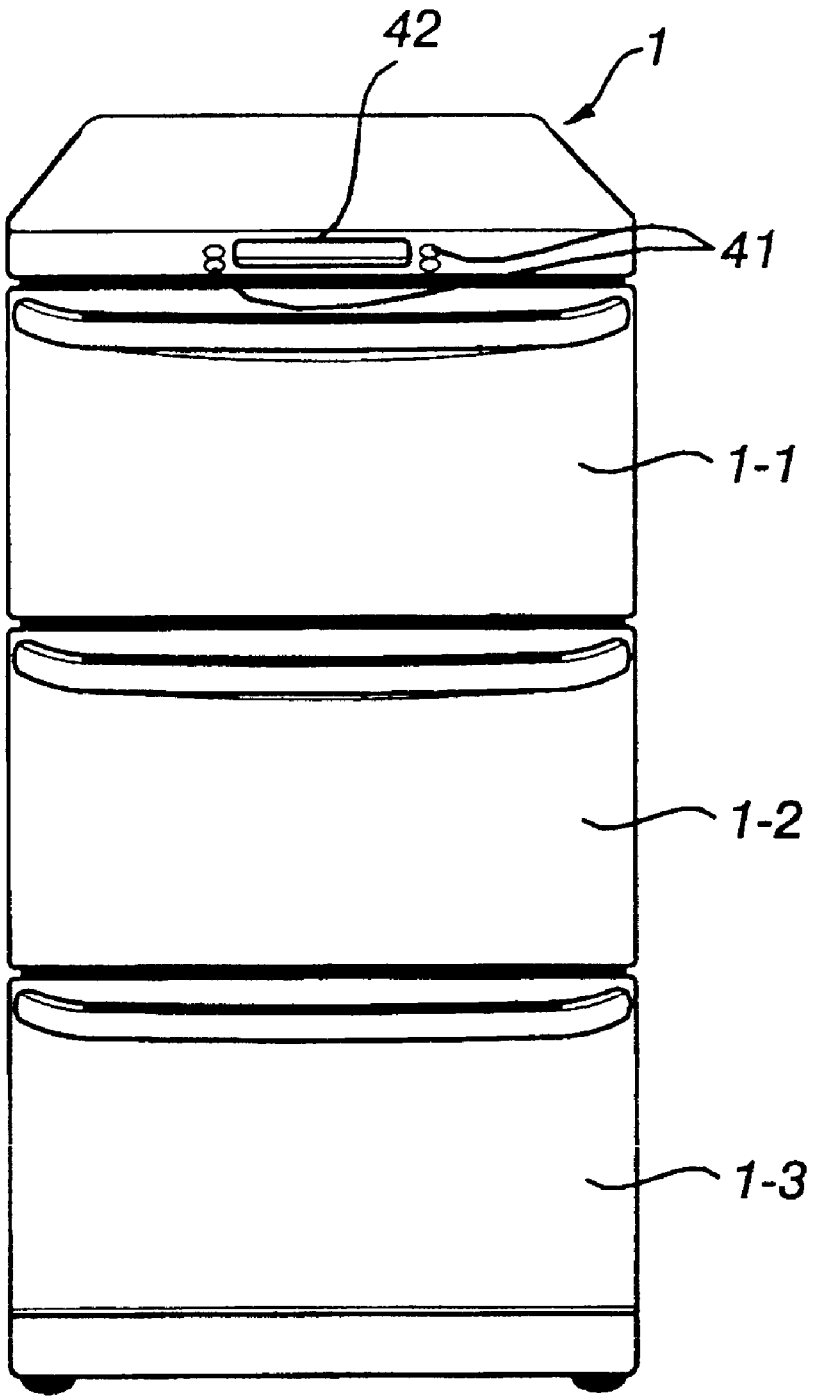
FIG. 1 is a front view illustrating the external appearance of a refrigerator to which a refrigerator setup system according to the present invention is applied.
Figure 2:
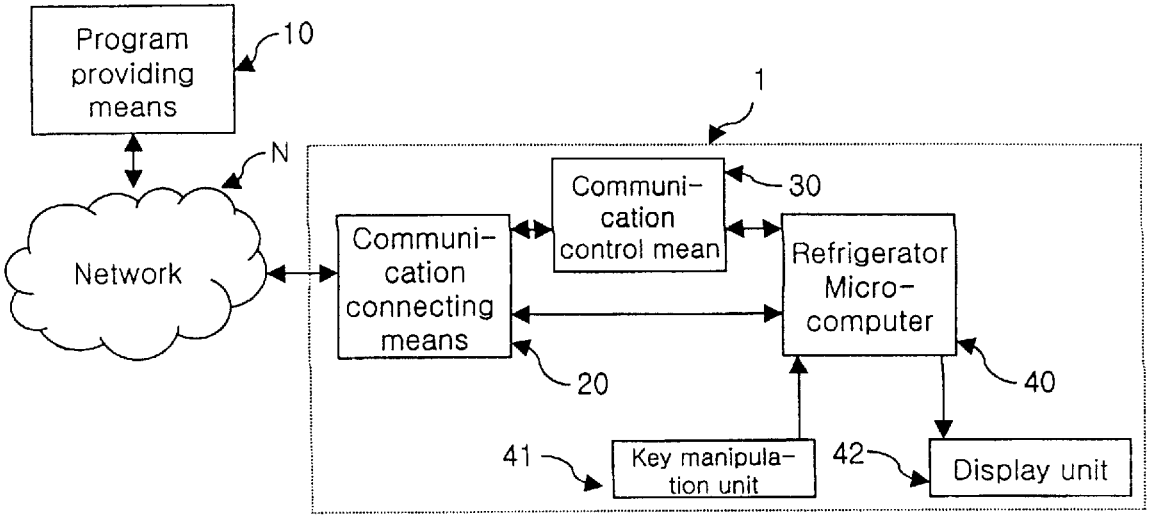
FIG. 2 is a block diagram illustrating the configuration of the refrigerator setup system according to the present invention.

Referring to FIG. 2, a setup system for a refrigerator according to the present invention is illustrated. As shown in FIG. 2, the refrigerator setup system includes program providing means 10 for providing an application program for setting up refrigerating and freezing environments for a refrigerator 1 meeting the local characteristics of the area where the refrigerator 1 is used, communication connecting means 20 for connecting the refrigerator 1 to the program providing means 10, and performing a conversion and processing of data transmitted or received between the refrigerator 1 and the program providing means 10 to make the data have a format meeting a transmission or reception standard, and communication control means 30 for controlling the communication connecting means 20 to connect the refrigerator 1 and the program providing means 10 to each other. The refrigerator setup system also includes a refrigerator microcomputer 40 for downloading the application program via the communication connecting means 20 under the control of the communication control means 30, installing the application program, and performing the entire control function of the refrigerator 1 to operate the refrigerator 1 to maintain the refrigerating and freezing environments set up by the installed application program.

The refrigerator microcomputer 40 is connected with a key manipulation unit 41 for receiving an input command from the user. Also, a display unit 42 is connected to the refrigerator microcomputer 40. The display unit 42 serves to display an image based on the input command, thereby allowing the user to select an application program for setting up refrigerating and freezing environments meeting the local characteristics of the area where the refrigerator 1 is used.

Under the condition in which the refrigerator 1 is connected to the program providing means 10 via the Internet by the communication connecting means 20, the user can download a desired application program by manipulating the key manipulation unit 41 while monitoring the image displayed on the display unit 42.

Figure 3A:
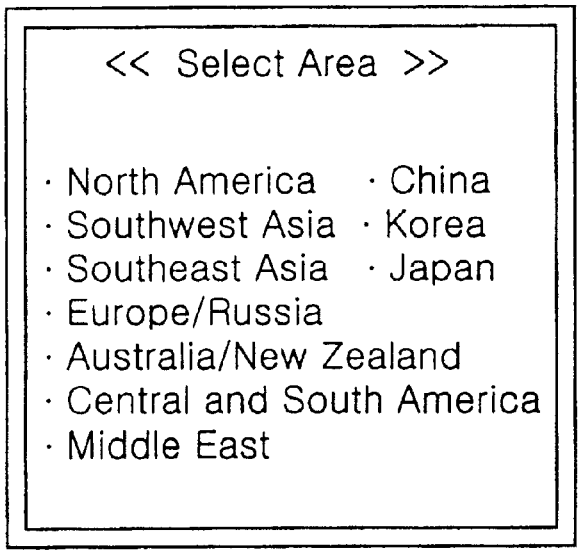
Figure 3B:
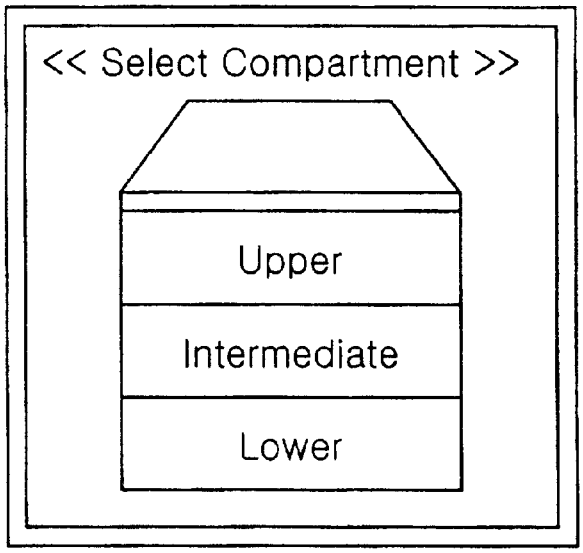

FIGS. 3*a* to 3*c* illustrate an example of the procedure for downloading a desired application program in accordance with a manipulation by the user.

FIG. 3*a* shows information displayed on the display unit 42 under the control of the refrigerator microcomputer 40 about areas where the refrigerator 1 can be used. Among the area information displayed on the display unit 42, the user selects desired area information corresponding to the area where the refrigerator 1 is used. In response to the selection of the desired area information, a menu for selecting respective compartments (in the illustrated case, upper, intermediate, and lower compartments) of the refrigerator 1 is displayed on the display unit 42, as shown in FIG. 3*b*. Accordingly, the user can select a desired one of the compartments respectively denoted is by the reference numerals 1-1, 2-1, and 3-1, in order to set up a desired refrigerating or freezing environment for the selected compartment. Thereafter, the display unit 42 displays information about diverse refrigerating and freezing environments, as shown in FIG. 3*c*, thereby allowing the user to select a desired one of the displayed refrigerating and freezing environments.

Although the area information displayed on the display unit 42 in the case of FIG. 3*a* is information about continental areas, each of these areas may be subdivided into local areas in order to set up refrigerating and freezing environments more accurately meeting the local characteristics of the area where the refrigerator 1 is used. In this case, for example, where the user selects "North America" on the menu of FIG. 3*a*, information about diverse areas in North America, for example, east, west, south, and north areas, may be displayed. Based on the displayed information, the user can select the area where the refrigerator 1 is used. Where the user selects "Europe" on the menu of FIG. 3*a*, information about diverse nations in Europe may be displayed on the display unit 42. Based on the displayed information, the user can select a desired nation.

Although the refrigerator setup system of the present invention is configured to allow the user to select a desired one of diverse refrigerating and freezing environments displayed on the display unit 42, it may be possible to allow the user to directly input desired refrigerating and freezing temperatures so as to install an application program in the refrigerator 1 based on the inputted refrigerating and freezing temperatures.

The program providing means 10 comprises an internet service provider (ISP) for providing an application program to the refrigerator 1 in an on-line fashion via a network N, in particular, the Internet. The application program provided by the program providing means 10 comprises programs for controlling respective refrigerating or freezing environments for the compartments included in the refrigerator 1.

When the user inputs information about a desired refrigerating or freezing environment for a selected compartment via the key manipulation unit 41, the refrigerator microcomputer 40 connects the refrigerator 1 to the program providing means 10 via the communication connecting means 20 in response to the inputted information, and transmits the inputted information to the program providing means 10. Thus, the refrigerator microcomputer 40 downloads a desired application program from the program providing means, based on the transmitted information.

The information about refrigerator using areas and refrigerating/freezing environments to be displayed on the display unit 42 may be stored in the refrigerator microcomputer 40. Alternatively, the information about refrigerator using areas and refrigerating/freezing environments may be provided by the program providing means 10. In the latter case, when the program providing means 10 transmits information about application programs in response to a connection of the refrigerator 1 thereto, it may simultaneously transmit the information about refrigerator using areas and refrigerating/freezing environments, so as to allow the transmitted information to be displayed on the display unit 42. Although the refrigerator setup system of the present invention is configured to allow the user to select desired refrigerating or freezing environments for respective compartments 1-1, 1-2, and 1-3, that is, to provide respective application programs for the compartments 1-1, 1-2, and 1-3, it may be configured to use a single application program capable of totally controlling the refrigerating and freezing environments of the compartments 1-1, 1-2, and 1-3. In this case, it is unnecessary for the user to select desired refrigerating or freezing environments for individual compartments, respectively.

As mentioned above, the program providing means 10 is stored with diverse application programs respectively associated with various storage conditions of diverse food to be stored in the refrigerator 1. Such application programs may include a kimchi-seasoning or fermenting application program for setting up a refrigerating or freezing environment suitable for the seasoning or fermentation of kimchi, and application programs for setting up diverse refrigerating or freezing environments shown in FIG. 3*c*.

Such application programs including the above mentioned kimchi-seasoning or fermenting application program set up different refrigerating or freezing environments for the refrigerator 1 meeting the local characteristics of the area where the refrigerator 1 is used, respectively.

Accordingly, even when the same kind of food is stored using the drawer type refrigerator 1 in different areas having different local characteristics, there is no problem in storing the food due to the different local characteristics because the refrigerator 1 used in each area has refrigerating and freezing environments meeting the local characteristics of that area.

The program providing means 10 is stored with diverse application programs capable of setting up diverse refrigerating and freezing environments suitable for storage of diverse food, for example, kimchi, fish, and meat, in different compartments. Accordingly, the user can select desired application programs to store diverse food, for example, kimchi in the upper compartment, fish in the intermediate compartment, and meat in the lower compartment.

Figure 4:
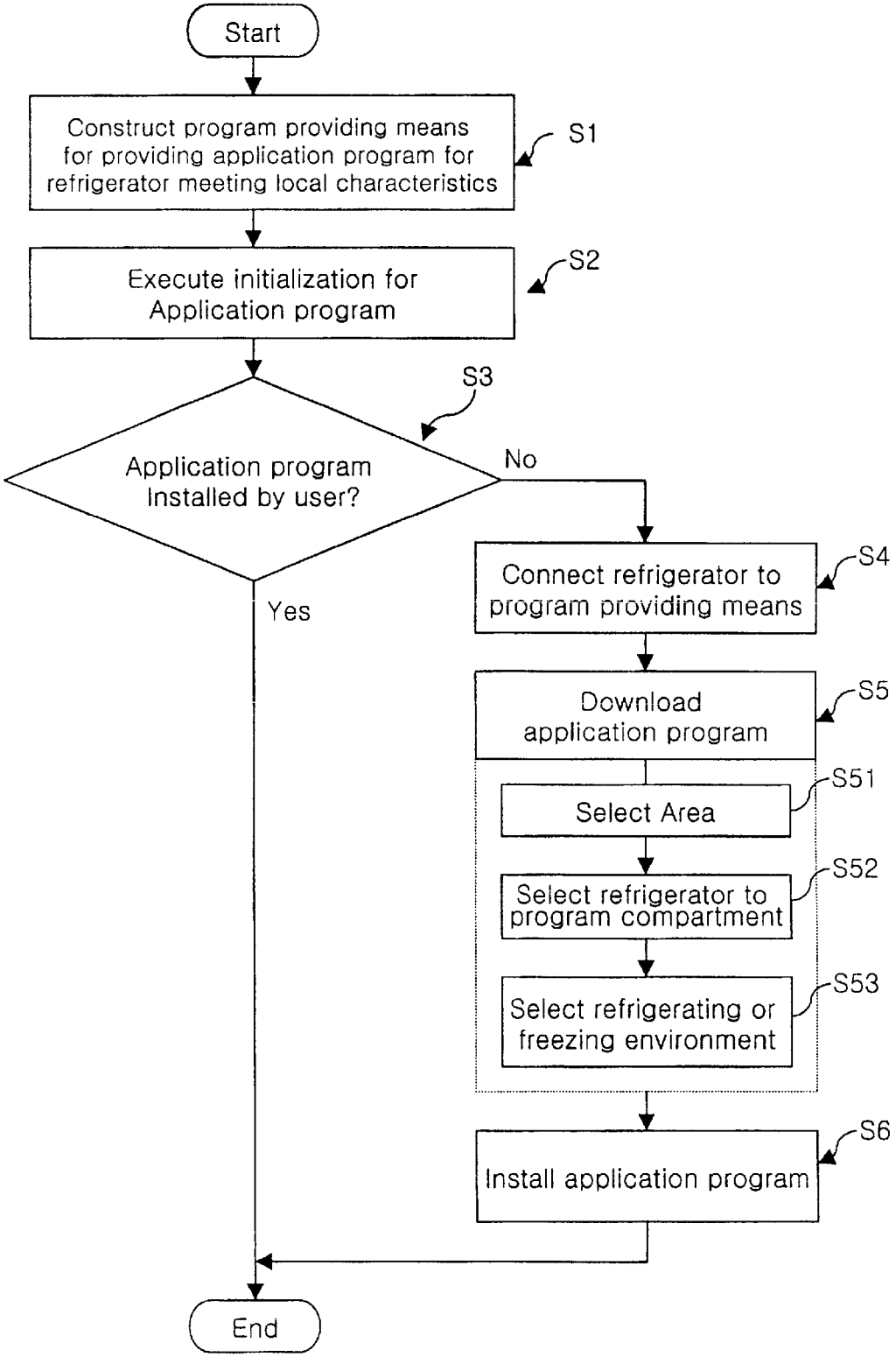
FIG. 4 is a flow chart illustrating a procedure for setting up desired refrigerating and freezing environments of the refrigerator using the refrigerator setup system according to the present invention

Now, the procedure for setting up desired refrigerating and freezing environments of the drawer type refrigerator using the refrigerator setup system having the above mentioned configuration according to the present invention will be described in conjunction with FIG. 4.

At first step, program providing means, which is stored with diverse application programs for the refrigerator respectively meeting diverse local characteristics, is constructed in a network (Step S1).

At second step, an initialization is executed for a desired application program adapted to control refrigerating and freezing environments of the refrigerator (Step S2).

At third step, the application program is installed in the refrigerator in accordance with a direct manipulation of the key manipulation unit by the user based on information displayed on the display unit, thereby setting up the refrigerator (Step S3).

If no manipulation by the user is made to directly set up the refrigerator, that is, to install the application program, at third step 83, the refrigerator is then connected to the program providing means via the network in an on-line fashion by the communication connecting means (Step S4).

At fifth step, the application program is downloaded from the program providing means in accordance with a direct manipulation of the key manipulation unit by the user based on a!, information displayed on the display unit (Step S5).

In order to download the application program desired for the refrigerator, the user first selects, from areas displayed on the display unit as shown in FIG. 3, the area where the refrigerator is used (Step S51).

Thereafter, the user selects, from a plurality of refrigerator compartments displayed on the display unit as shown in FIG. 3*b*, a desired refrigerator compartment, for which a desired refrigerating or freezing environment is to be set up (Step S52).

For the selected refrigerator compartment, the user then selects a desired one from diverse refrigerating and freezing environments displayed on the display unit as shown in FIG. 3*c* (Step S53).

At sixth step, the application program downloaded at fifth step S5 is installed in the refrigerator, thereby setting up the refrigerator (Step S6). Thus, refrigerating and freezing environments of the refrigerator is set up which meet the local characteristics of the area where the refrigerator is used.

As apparent from the above description, the present invention provides a setup system and method for a drawer type refrigerator capable of allowing the user to install, directly or via a network, an application program meeting the local characteristics of the area where the refrigerator is used, thereby allowing the refrigerator to have optimum refrigerating and freezing environments meeting the local characteristics of the area.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A refrigerator setup system comprising:

program providing means for providing an application program for setting up refrigerating and freezing environments for a refrigerator meeting local characteristics of an area where the refrigerator is used;

communication connecting means provided at the refrigerator and adapted to allow the refrigerator to download the application program from the program providing means;

communication control means for controlling the communication connecting means to connect the refrigerator and the program providing means to each other; and a refrigerator microcomputer for performing a control for refrigerating and freezing functions of the refrigerator in accordance with the downloaded application program.

2. The refrigerator setup system according to claim 1, wherein:

the refrigerator is provided with a plurality of compartments respectively adapted to perform independent refrigerating or freezing functions; and the application program provided by the program providing means comprises programs for controlling respective refrigerating or freezing environments for the compartments included in the refrigerator.

3. The refrigerator setup system according to claim 2, wherein each of the compartments has a drawer structure capable of being forwardly drawn to open the compartment.

4. The refrigerator setup system according to claim 1, wherein the program providing means comprises an internet service provider for providing the application program to the refrigerator via a network.

5. The refrigerator setup system according to claim 1, further comprising:

a key manipulation unit connected to the refrigerator microcomputer and adapted to select an optimum one of diverse application programs.

6. The refrigerator setup system according to claim 1, further comprising:

a display unit connected to the refrigerator microcomputer and adapted to display information associated with the downloading of the application program.

7. A refrigerator setup method comprising the steps of:

(a) constructing program providing means adapted to provide an application program meeting local characteristics of an area where a refrigerator is used; and (b) connecting the program providing means to communication connecting means provided at the refrigerator, downloading the application program from the program providing means to the refrigerator, and installing the application program in the refrigerator.

8. The refrigerator setup method according to claim 7, wherein the step (b) is executed when a user does not perform a manipulation for directly selecting a desired application program, stored in a microcomputer provided at the refrigerator, to install the application program.

9. The refrigerator setup method according to claim 7, wherein the step (b) comprises the step of selecting, diverse application programs stored in the program providing means, the application program meeting the local characteristics of the area where the refrigerator is used.

10. The refrigerator setup method according to claim 9, wherein the step (b) further comprises the step of selecting, from a plurality of refrigerator compartments provided at the refrigerator, a desired refrigerator compartment, for which a desired refrigerating or freezing environment is to be set up, before or after the selection of the application program meeting the local characteristics of the area where the refrigerator is used.

11. The refrigerator setup method according to claim 10, wherein the step (b) further comprises the step of selecting the refrigerating or freezing environment, to be set up, before or after the selection of the refrigerator compartment.

* * * * *